US010328302B2

(12) United States Patent
Yeh

(10) Patent No.: US 10,328,302 B2
(45) Date of Patent: Jun. 25, 2019

(54) ROCK CLIMBING MACHINE

(71) Applicant: Yung-Sung Yeh, New Taipei (TW)

(72) Inventor: Yung-Sung Yeh, New Taipei (TW)

( * ) Notice: Subject to any disclaimer, the term of this patent is extended or adjusted under 35 U.S.C. 154(b) by 104 days.

(21) Appl. No.: 15/803,072

(22) Filed: Nov. 3, 2017

(65) Prior Publication Data

US 2019/0134456 A1 May 9, 2019

(51) Int. Cl.
*A63B 21/22* (2006.01)
*A63B 22/00* (2006.01)

(52) U.S. Cl.
CPC ..... *A63B 22/0056* (2013.01); *A63B 21/225* (2013.01); *A63B 22/001* (2013.01); *A63B 2022/0043* (2013.01)

(58) Field of Classification Search
CPC ..... A63B 21/02; A63B 2022/00; A63B 22/00
See application file for complete search history.

(56) References Cited

U.S. PATENT DOCUMENTS 5,199,932 A * 4/1993 Liao ..... A63B 22/001 482/113
5,199,933 A * 4/1993 Illuzzi ..... A63B 23/0476 482/62
5,256,117 A * 10/1993 Potts ..... A63B 21/157 482/52
5,417,630 A * 5/1995 Schultz ..... A63B 21/154 482/70
5,492,515 A * 2/1996 Charnitski ..... A63B 22/001 482/37
5,749,810 A * 5/1998 Fenstermaker .. A63B 23/03575 482/57
5,928,115 A * 7/1999 Arroyo, Jr. ..... A63B 22/0002 482/51
6,135,923 A * 10/2000 Stearns ..... A63B 22/001 482/51
6,155,959 A * 12/2000 Arroyo, Jr. ..... A63B 21/012 482/37
6,533,708 B2 * 3/2003 Taggett ..... A63B 22/001 482/51
7,686,743 B2 * 3/2010 Eschenbach ..... A63B 21/015 482/51
8,025,608 B2 * 9/2011 Popescu ..... A63B 23/1209 482/111
8,047,968 B2 * 11/2011 Stewart ..... A63B 22/001 482/51
9,421,418 B2 * 8/2016 Skrashevskiy ... A63B 23/03533
10,179,260 B1 * 1/2019 Stearns ..... A63B 22/04
10,179,265 B2 * 1/2019 Carr ..... A63B 24/0087
2007/0142176 A1 * 6/2007 Brown ..... A63B 22/001 482/7

(Continued)

*Primary Examiner* — Garrett K Atkinson
(74) *Attorney, Agent, or Firm* — Egbert Law Offices, PLLC

(57) ABSTRACT

A rock climbing has a base placed flat on a bearing surface, a damping device mounted on the base, a pedal structure is connected to both sides of the damping device respectively and two rock climbing simulators upright fixed to the base. The two rock climbing simulators are mounted on both sides of the damping device respectively. Each rock climbing simulator is provided with a slide grip device, and each grip device is connected to a corresponding pedal structure. When the two pedal structures are trodden alternately, the corresponding grip devices reciprocate up and down, simulating the rock climbing action.

5 Claims, 5 Drawing Sheets

(56) References Cited

U.S. PATENT DOCUMENTS

| | | | | |
|---|---|---|---|---|
| 2008/0214363 | A1* | 9/2008 | Eschenbach | A63B 21/015<br>482/52 |
| 2010/0041520 | A1* | 2/2010 | Popescu | A63B 21/015<br>482/37 |
| 2011/0086743 | A1* | 4/2011 | Stewart | A63B 22/001<br>482/52 |
| 2013/0343849 | A1* | 12/2013 | Gobert | B60P 1/5438<br>414/540 |
| 2016/0354638 | A1* | 12/2016 | Carr | A63B 24/0087 |
| 2017/0252594 | A1* | 9/2017 | McKenna | A63B 21/00069 |
| 2018/0111019 | A1* | 4/2018 | Ellis | A63B 21/068 |
| 2019/0009129 | A1* | 1/2019 | Liao Lai | A63B 22/04 |

* cited by examiner

ROCK CLIMBING MACHINE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an exercise equipment, and more particularly to an innovative structural design with the exercise effects of a stair stepper and a rock climbing machine.

2. Description of Related Art Including Information Disclosed Under 37 CFR 1.97 And 37 CFR 1.98

In the stair stepper structural design, the left and right pedal levers and the drag wheel must be connected by a transmission mechanism, so that the left and right pedal levers drive the drag wheel to rotate as the left and right pedals are actuated up and down, with the default drag device (e.g. magnetic control) to implement an appropriate drag effect.

In terms of the common stair stepper structure on the present market, the transmission mechanism between the left and right pedal levers and the drag wheel is rope transmission. However, this known design still has the following problems in practical application. The rope transmission form is limited to its gravity drive structure form, it must be set as two-stage transmission form to reach the expected gravity state, but there will be some defects and problems, such as high cost and difficult assembly, and the belt is likely to slip, drop, escape, break and turn over.

Furthermore, since the early simple stair steppers are usually free of hand grip structure, the center of gravity is often unstable. Therefore, some suppliers mount a vertical member on the conventional stair steppers, and mount structures for hands to grip and for supporting the forearms on both sides of the vertical member. However, this design does not conform with human engineering, like walking, both hands must swing alternately with both feet, so as to obtain the optimum equilibrium state during movement or traveling. Some suppliers developed oscillating levers, such a structure may remedy the deficiencies in said stair steppers. However, the movement track of the oscillating lever free end part of general exercise equipments is an upward projecting arc line, mismatching the hand movement track of human engineering.

In addition, the existing rock climbing machines usually use strong gravity load to exercise muscles as primary exercise objective, so they are not suitable for young and old people. Furthermore, some exercise equipment is placed in the department of rehabilitation of hospitals for the wounded to rehabilitate muscle strength or muscles, if the gravity load is too heavy, there may be sports injuries before the rehabilitation takes effect. Therefore, how to adjust the gravity load of exercise equipment most effectively to provide different functions in appropriate environment, such as muscle exercise or physical rehabilitation, to expand the range of use (application) of exercise equipment, is actually the objective and direction to be thought about and broken through by related circles.

BRIEF SUMMARY OF THE INVENTION

The present invention provides dual functions of stair stepper and rock climbing machine simultaneously, it can increase the sport efficiency, and it can be preliminary training before formal rock climbing, reducing the threshold of rock climbing. The operating angle of the first connecting bar and the second connecting bar of transmission mechanism is changed, the tilt angle of the second connecting bar of the transmission mechanism does not exceed the backward inclination angle of vertical angle, so as to evade driving dead point, the operation is smoother, the sport efficiency is increased. It works as preliminary exercise equipment for rock climbing, and provides better transmission efficiency.

DETAILED DESCRIPTION OF THE INVENTION

Figure 1:
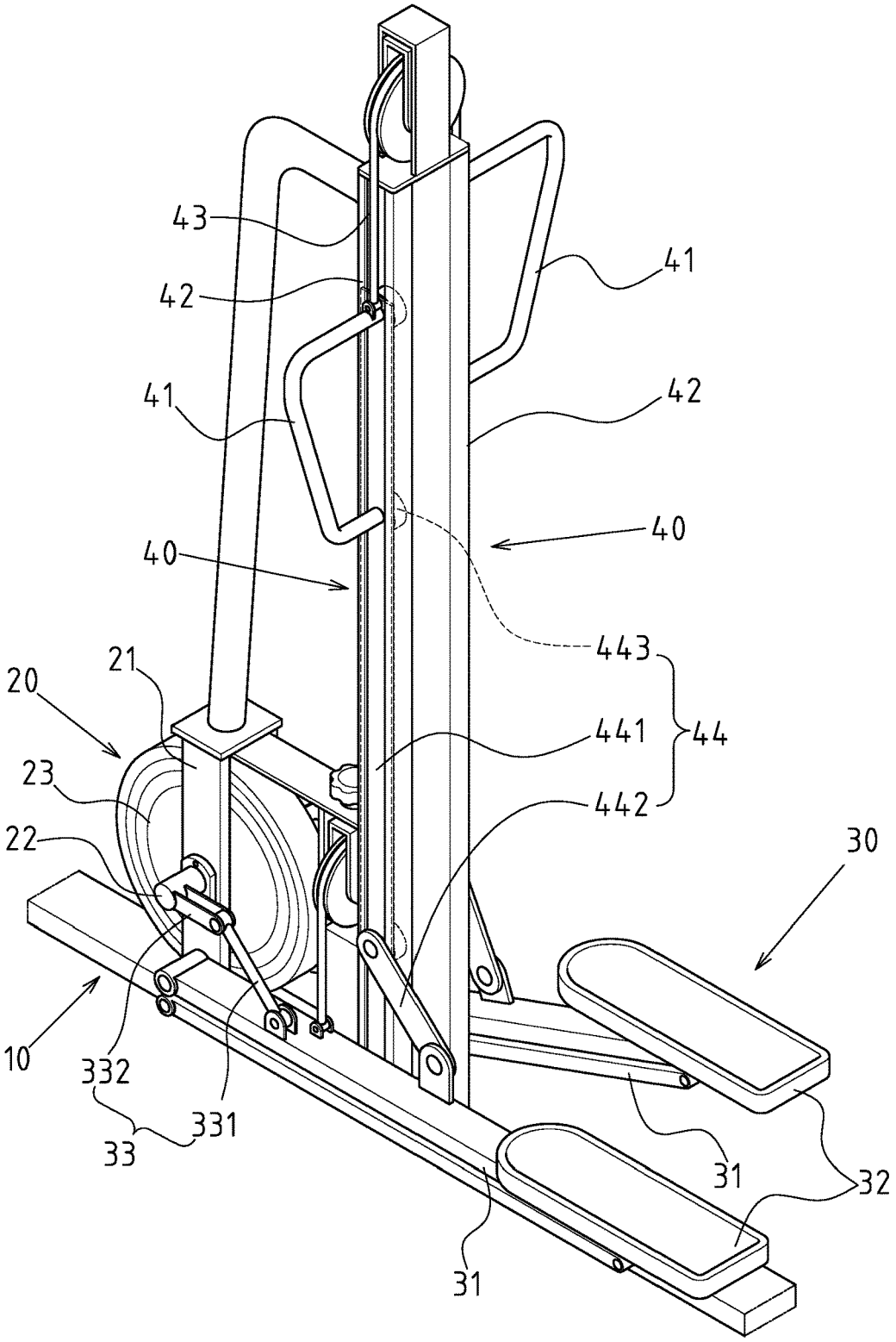
FIG. 1 is a three-dimensional outside view of the present invention.
Figure 2:
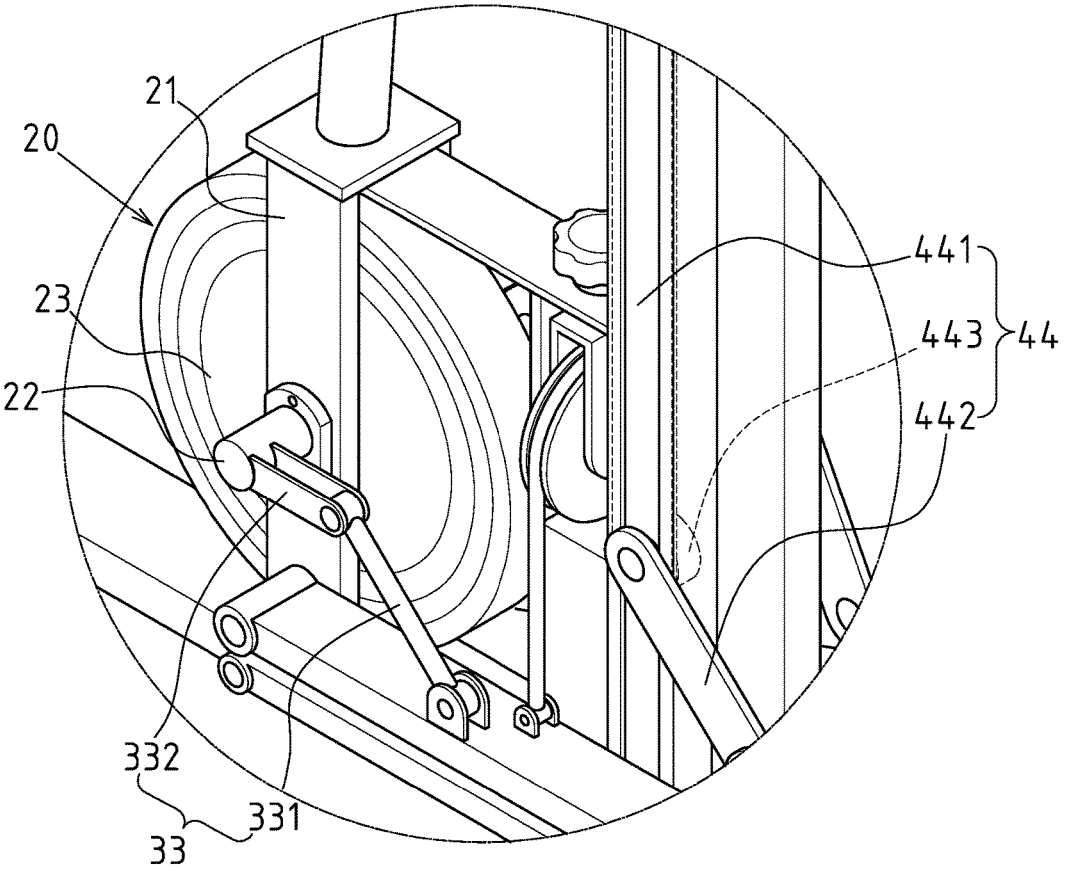
FIG. 2 is a partial three-dimensional outside view of the present invention.

FIGS. 1, 2, 3 and 4 show the preferred embodiments of rock climbing machine of the present invention, but the embodiments are for illustration only, the patent application is not limited to this structure. Said rock climbing machine comprises a base 10 placed flat on a bearing surface, a damping device 20 mounted on base 10, a pedal structure 30 is connected to both sides of the damping device 20 respectively, two rock climbing simulators 40 upright fixed to base 10. The two rock climbing simulators 40 are mounted on both sides of the damping device 20 respectively, a slide grip device 41 is located at the top of each rock climbing simulator 40, and each grip device 41 is connected to a corresponding pedal structure 30. When the two pedal structures 30 are pedaled alternately, driving the corresponding grip device 41 to move up and down, so as to simulate rock climbing actions.

The damping device 20 comprises a mounting rack 21 fixed to base 10 and a counterweight flywheel 23 screwed in mounting rack 21 by shaft 22.

Each pedal structure 30 comprises an oscillating arm 31 with front end pivoted on mounting rack 21, the oscillating arm 31 is a connecting lever structure, and its free end is provided with a pedal 32 for the user to step on. The oscillating arm 31 is connected to damping device 20 by a transmission mechanism 33. The transmission mechanism 33 comprises a first connecting bar 331 with end pivoted on oscillating arm 31 and a second connecting bar 332 with end radially fixed to a corresponding end of shaft 22. The free ends of the first connecting bar 331 and the second connecting bar 332 are pivoted on each other.

Figure 3:
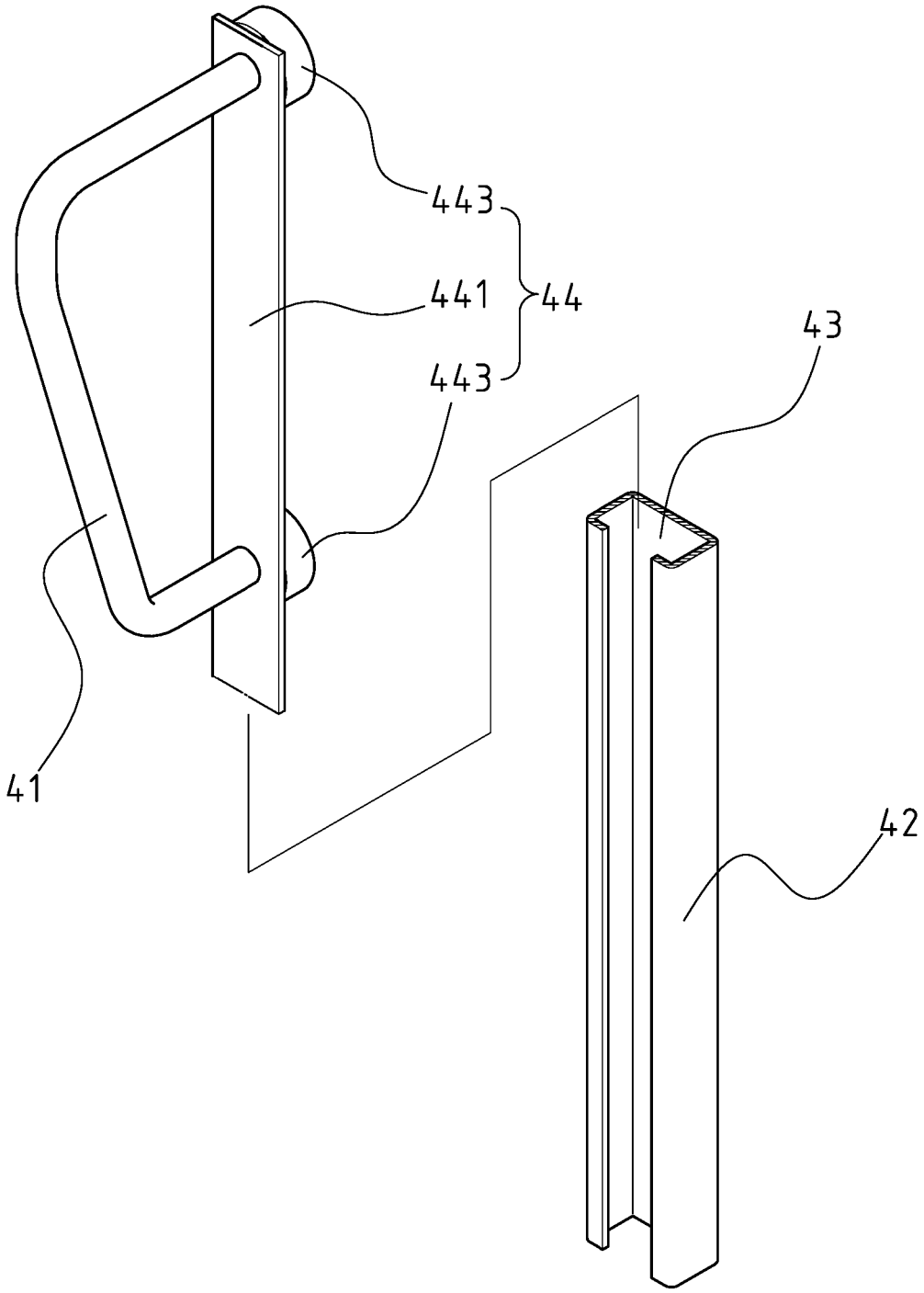
FIG. 3 is a partial three-dimensional exploded diagram of rock climbing simulator of the present invention.

Each rock climbing simulator 40 comprises a rail 42 upright or inclining forward fixed to base 10, the rail 42 contains a longitudinal slideway 43 with opening outward, as shown in FIG. 3. The rock climbing simulator 40 comprises a driving mechanism 44 connected to oscillating arm 31. The driving mechanism 44 comprises a first connecting bar 441 and a second connecting bar 442. The first connecting bar 441 is held in the slideway 43 and reciprocates against rail 42. The first end of the second connecting bar 442 is pivoted on the bottom of the first connecting bar 441 and the second end is pivoted on oscillating arm 31. The grip device 41 is laterally fixed to the top of the first connecting bar 441. There are plural rollers 443 on the underside of the first connecting bar 441, so as to reduce the friction between the first connecting bar 441 and rail 42, and to guarantee that the first connecting bar 441 and grip device 41 can perform straight reciprocating movement against rail 42. In addition, the grip device 41 of each rock climbing simulator 40 is located between damping device 20 and pedal 32.

Figure 4:
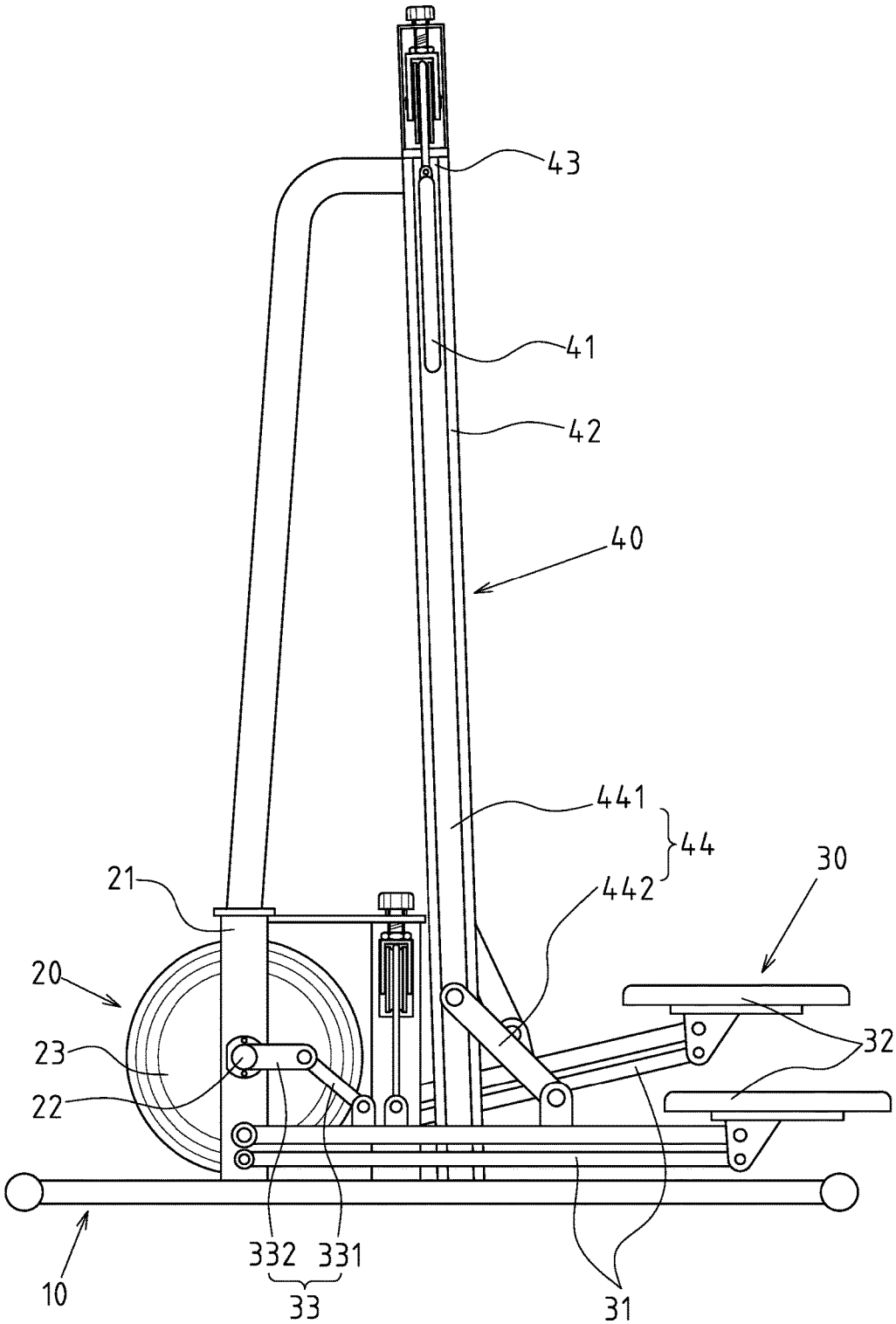
FIG. 4 is a side view of the present invention.
Figure 5:
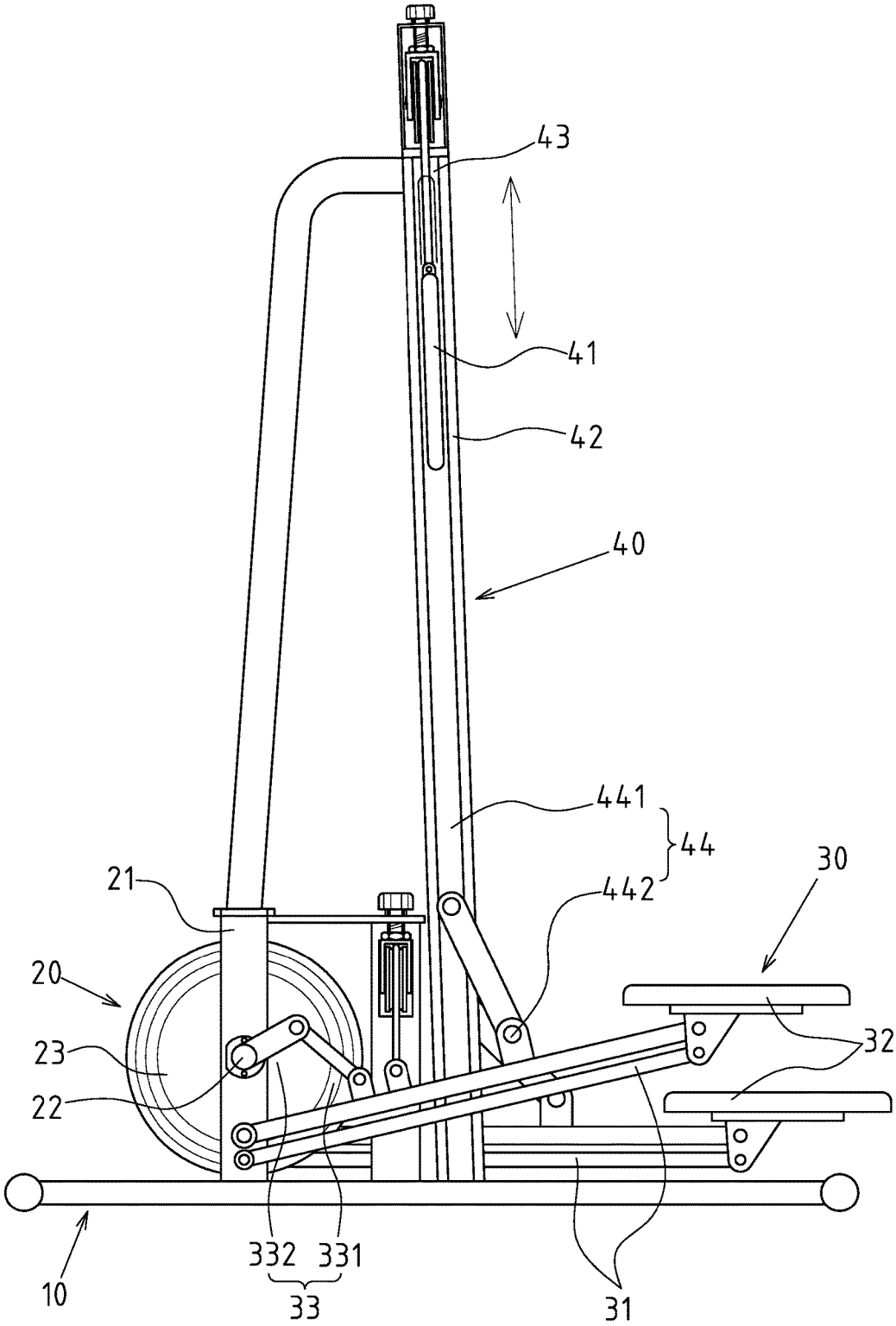
FIG. 5 is a schematic diagram of actuation of the present invention.

According to said structural composition design, the actuation of the present invention is described below. FIGS. 4 and 5 are the schematic diagrams of up-and-down rotary oscillation actuation of two pedal structures 30 of the rock climbing machine. The pedal 32 on one side is trodden downward, so that the pedal 32 on the opposite side rises upward. In this process, the two pedal structures 30 are interlocked to the damping device 20 by the transmission mechanism 33 respectively, the counterweight flywheel 23 of damping device 20 provides appropriate drag, this repeated actuation attains the effect of step exercise. The oscillating arm 31 swinging downward draws the first connecting bar 441 downward via the second connecting bar 442, so that the first connecting bar 441 and grip device 41 move down along the slideway 43 in rail 42. The oscillating arm 31 swinging upward on the opposite side underprops the first connecting bar 441 upward via the second connecting bar 442, so that the first connecting bar 441 and grip device 41 move up along the slideway 43 in rail 42. When the user treads pedal 32 and both hands grip the grip device 41 on both sides respectively, the grip devices 41 moving up and down alternately simulate the rock climbing action, so that the user attains the effect of step exercise and the effect of rock climbing simultaneously, not only providing double exercise effect, but also further coordinating the user's limbs, and it can be the preliminary training before formal rock climbing.

In addition, as shown in FIGS. 4 and 5, when the oscillating arm 31 swings upward to the preset maximum tilt angle, forming the minimum included angle between the first connecting bar 331 and the second connecting bar 332 of transmission mechanism 33, the tilt angle of the second connecting bar 332 does not exceed the backward inclination angle of vertical angle, so as to evade driving dead point, the transmission mechanism 33 of the present invention can be interlocked to counterweight flywheel 23 most smoothly.

It is noteworthy that the present invention can rehabilitate limbs. By means of reducing the damping effect provided by damping device 20, the damping effect provided by the global entity is adjusted to the patient's or senior's demand or limit according to the rehabilitation doctor's advice, the patient's or senior's demand for rehabilitation is met by moderate motion, so as to expand the range of use and added value of exercise equipments.

I claim:

1. A rock climbing machine comprises:

a base;

a damping device mounted on the base, the damping device comprises a mounting rack fixed to base and a counterweight flywheel screwed in the mounting rack by a shaft;

two pedal structures mounted on both sides of the damping device respectively; the two pedal structures are interlocked to the damping device by a transmission mechanism; each pedal structure comprises an oscillating arm with a front end pivoted on the mounting rack, the free end of the oscillating arm is provided with a pedal for the user to step on; the transmission mechanism comprises a first connecting bar with an end pivoted on the oscillating arm and a second connecting bar with an end fixed to a corresponding end of the shaft; the free ends of the first connecting bar and the second connecting bar are pivoted on each other; and two upright rock climbing simulators fixed to the base; a slide grip device is located at the top of each rock climbing simulator, and each grip device is connected to a corresponding pedal structure, and the grip device of each rock climbing simulator is located between the damping device and pedal; each rock climbing simulator comprises: an upright rail fixed to the base; the rail containing a longitudinal slideway with an outward opening, the grip device operable to slide up and down along the slideway during actuation; and a driving mechanism connected to a corresponding pedal structure; the driving mechanism comprises a first connecting bar and a second connecting bar; the first connecting bar is held in the slideway and operable to reciprocate against the rail; the first end of the second connecting bar is pivoted on the bottom of the first connecting bar, and the second end is pivoted on the corresponding pedal structure; the grip device is laterally fixed to the top of the first connecting bar.

2. The device defined in claim 1, wherein there are a plurality of rollers on the underside of the first connecting bar, so that the first connecting bar and grip device can perform straight reciprocation against the rail.

3. The device defined in claim 1, wherein the end of the second connecting bar of the transmission mechanism different from the first connecting bar of the transmission mechanism is radially fixed to the shaft.

4. The device defined in claim 1, wherein the section of the slideway is set as T-shape.

5. The device defined in claim 3, wherein the section of the slideway is set as T-shape.

* * * * *